US007304658B2

(12) United States Patent
Naito et al.

(10) Patent No.: US 7,304,658 B2
(45) Date of Patent: Dec. 4, 2007

(54) THERMAL PRINTER AND METHOD FOR CORRECTING THE ENERGIZING TIME DATA FOR HEATING ELEMENTS IN THE THERMAL PRINTER

(75) Inventors: Tadahiro Naito, Kadoma (JP); Yutaka Noda, Sanda (JP)

(73) Assignee: Funai Electric Co., Ltd., Osaka (JP)

( * ) Notice: Subject to any disclaimer, the term of this patent is extended or adjusted under 35 U.S.C. 154(b) by 238 days.

(21) Appl. No.: 11/294,606

(22) Filed: Dec. 6, 2005

(65) Prior Publication Data

US 2006/0132581 A1 Jun. 22, 2006

(30) Foreign Application Priority Data

Dec. 21, 2004 (JP) ..... 2004-370138

(51) Int. Cl.
*B41J 2/36* (2006.01)

(52) U.S. Cl. ..... 347/195; 400/120.15

(58) Field of Classification Search ..... 347/195; 400/120.15

See application file for complete search history.

(56) References Cited

U.S. PATENT DOCUMENTS 4,685,069 A * 8/1987 Inui et al. ..... 347/196
4,878,065 A * 10/1989 Fukushima et al. ..... 347/195
4,912,458 A * 3/1990 Comeau et al. ..... 340/576
5,483,273 A 1/1996 Fujimoto et al. ..... 347/195

FOREIGN PATENT DOCUMENTS

| | | |
|---|---|---|
| JP | 61015469 | 1/1986 |
| JP | 64001560 | 1/1989 |
| JP | A-06-255141 | 9/1994 |
| JP | A-07-052436 | 2/1995 |
| JP | 8244266 | 9/1996 |

* cited by examiner

*Primary Examiner*—Huan Tran
(74) *Attorney, Agent, or Firm*—Bacon & Thomas, PLLC

(57) ABSTRACT

A thermal printer comprises: a ROM 11 for storing a heat history correction table; a RAM 12 for storing the density-related energizing time data for the first and second preceding lines printed immediately before the current line to be printed and the density-related energizing time data before a correction for the current line to be printed which includes a target dot T; and a control section for comparing the density-related energizing time data for the first and second preceding lines and the density-related energizing time data before a correction for both adjacent dots T1 and T2 of the target dot T with the density-related energizing time data before a correction for the target dot T to select reference data, and further for performing a corrective operation for the pre-correction energizing time data for the target dot T using thus selected reference data to calculate energizing time data for the target dot T to be printed, whereby it is possible to prevent the temperature of a thermal head from being reduced excessively.

8 Claims, 14 Drawing Sheets

FIG.8(a)
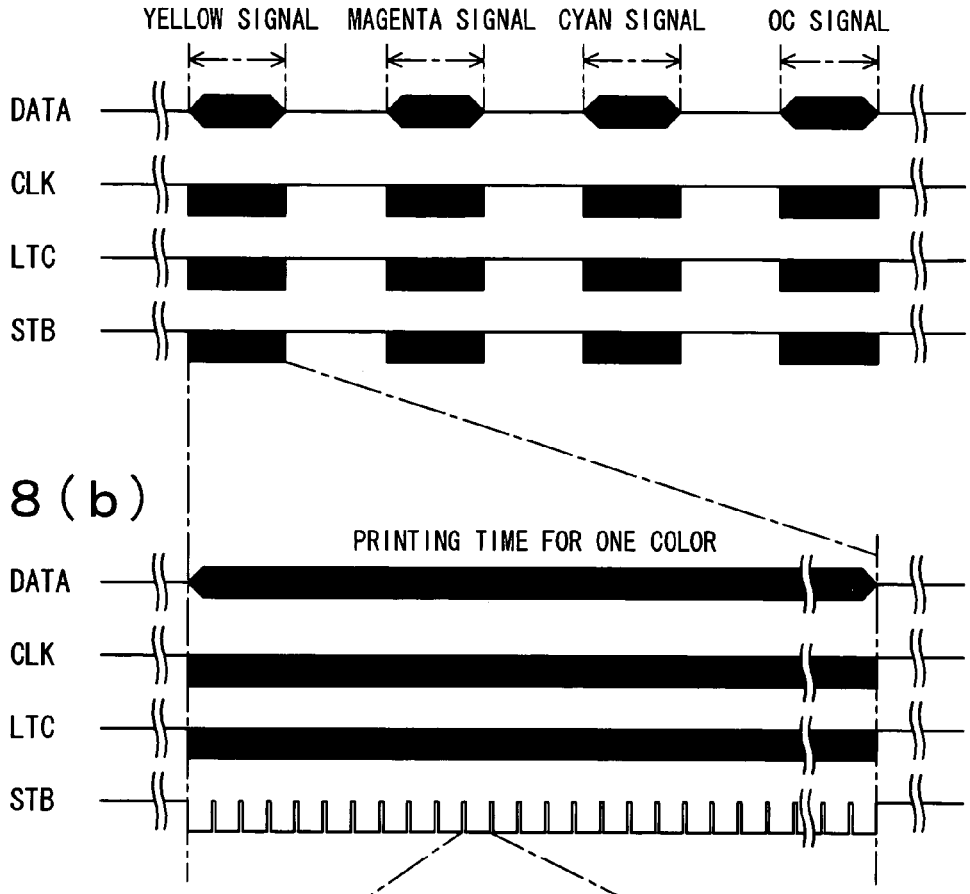
FIG.8(b)
FIG.8(c)
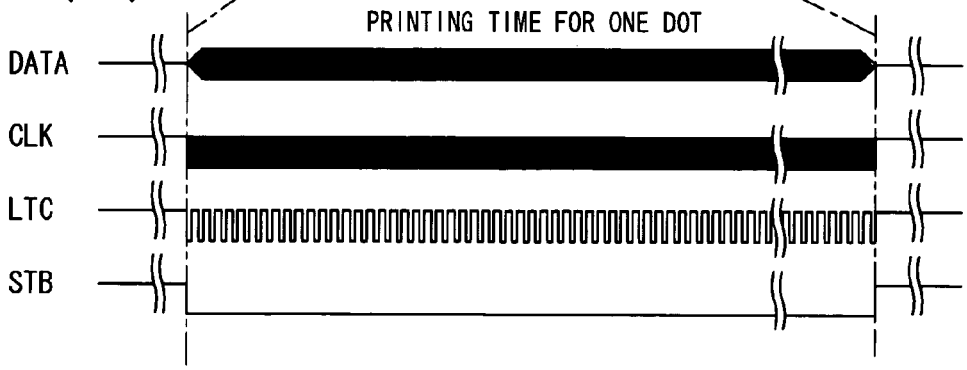

FIG. 12 (a)

| | DENSITY-RELATED ENERGIZING TIME FOR THE PRECEDING LINES | DENSITY-RELATED ENERGIZING TIME FOR THE CURRENT LINE | REFERENCE DATA | t'T |
|---|---|---|---|---|
| T | | 248 | | |
| T1 | | 8 | | |
| T2 | | 5 | | |
| A | | | | |
| A1 | | | | |
| A2 | | | | |
| B | | | | |
| B1 | | | | |
| B2 | | | | |
| POST-CORRECTION DENSITY-RELATED ENERGIZING TIME DATA (POST-CORRECTION HEAD CONTROL SIGNAL (Hb)) | | | | |

FIG. 12 (b)

| | DENSITY-RELATED ENERGIZING TIME FOR THE PRECEDING LINES | DENSITY-RELATED ENERGIZING TIME FOR THE CURRENT LINE | REFERENCE DATA | t'T |
|---|---|---|---|---|
| T | | 248 | | |
| T1 | | 8 | | |
| T2 | | 5 | | |
| A | 15 | | | |
| A1 | 10 | | | |
| A2 | 250 | | | |
| B | 254 | | | 171 |
| B1 | 1 | | | |
| B2 | 3 | | | |
| POST-CORRECTION DENSITY-RELATED ENERGIZING TIME DATA (POST-CORRECTION HEAD CONTROL SIGNAL (Hb)) | | | | |

FIG. 12 (c)

| | DENSITY-RELATED ENERGIZING TIME FOR THE PRECEDING LINES | DENSITY-RELATED ENERGIZING TIME FOR THE CURRENT LINE | REFERENCE DATA | t'T |
|---|---|---|---|---|
| T | | 248 | | |
| T1 | | 8 | -2 | |
| T2 | | 5 | -1 | |
| A | 15 | | -3 | |
| A1 | 10 | | -2 | |
| A2 | 250 | | -34 | |
| B | 254 | | -35 | 171 |
| B1 | 1 | | +1 | |
| B2 | 3 | | +1 | |
| POST-CORRECTION DENSITY-RELATED ENERGIZING TIME DATA (POST-CORRECTION HEAD CONTROL SIGNAL (Hb)) | | | | |

FIG. 12 (d)

| | DENSITY-RELATED ENERGIZING TIME FOR THE PRECEDING LINES | DENSITY-RELATED ENERGIZING TIME FOR THE CURRENT LINE | REFERENCE DATA | t'T |
|---|---|---|---|---|
| T | | 248 | | |
| T1 | | 8 | -2 | |
| T2 | | 5 | -1 | |
| A | 15 | | -3 | |
| A1 | 10 | | -2 | |
| A2 | 250 | | -34 | |
| B | 254 | | -35 | 171 |
| B1 | 1 | | +1 | |
| B2 | 3 | | +1 | |
| POST-CORRECTION DENSITY-RELATED ENERGIZING TIME DATA (POST-CORRECTION HEAD CONTROL SIGNAL (Hb)) | | | 173 | |

FIG. 14 (a)

| | DENSITY-RELATED ENERGIZING TIME FOR THE PRECEDING LINES | DENSITY-RELATED ENERGIZING TIME FOR THE CURRENT LINE | REFERENCE DATA | t'T |
|---|---|---|---|---|
| T | | 248 | | |
| T1 | | | | |
| T2 | | 5 | | |
| A | | | | |
| A1 | | | | |
| A2 | | | | |
| B | | | | |
| B1 | | | | |
| B2 | | | | |
| POST-CORRECTION DENSITY-RELATED ENERGIZING TIME DATA (POST-CORRECTION HEAD CONTROL SIGNAL (Hb)) | | | | |

FIG. 14 (b)

| | DENSITY-RELATED ENERGIZING TIME FOR THE PRECEDING LINES | DENSITY-RELATED ENERGIZING TIME FOR THE CURRENT LINE | REFERENCE DATA | t'T |
|---|---|---|---|---|
| T | | 248 | | |
| T1 | 3 | | | |
| T2 | | 5 | | |
| A | 15 | | | |
| A1 | 10 | | | |
| A2 | 250 | | | |
| B | 254 | | | |
| B1 | 1 | | | |
| B2 | 3 | | | |
| POST-CORRECTION DENSITY-RELATED ENERGIZING TIME DATA (POST-CORRECTION HEAD CONTROL SIGNAL (Hb)) | | | | |

FIG. 14 (c)

| | DENSITY-RELATED ENERGIZING TIME FOR THE PRECEDING LINES | DENSITY-RELATED ENERGIZING TIME FOR THE CURRENT LINE | REFERENCE DATA | t'T |
|---|---|---|---|---|
| T | | 248 | | |
| T1 | 3 | | -2 | |
| T2 | | 5 | -1 | |
| A | 15 | | -3 | |
| A1 | 10 | | -2 | |
| A2 | 250 | | -34 | |
| B | 254 | | -35 | 174 |
| B1 | 1 | | +1 | |
| B2 | 3 | | +1 | |
| POST-CORRECTION DENSITY-RELATED ENERGIZING TIME DATA (POST-CORRECTION HEAD CONTROL SIGNAL (Hb)) | | | | |

FIG. 14 (d)

| | DENSITY-RELATED ENERGIZING TIME FOR THE PRECEDING LINES | DENSITY-RELATED ENERGIZING TIME FOR THE CURRENT LINE | REFERENCE DATA | t'T |
|---|---|---|---|---|
| T | | 248 | | |
| T1 | | | -2 | |
| T2 | | 5 | -1 | |
| A | 15 | | -3 | |
| A1 | 10 | | -2 | |
| A2 | 250 | | -34 | |
| B | 254 | | -35 | 174 |
| B1 | 1 | | +1 | |
| B2 | 3 | | +1 | |
| POST-CORRECTION DENSITY-RELATED ENERGIZING TIME DATA (POST-CORRECTION HEAD CONTROL SIGNAL (Hb)) | | | 176 | |

THERMAL PRINTER AND METHOD FOR CORRECTING THE ENERGIZING TIME DATA FOR HEATING ELEMENTS IN THE THERMAL PRINTER

BACKGROUND OF THE INVENTION

1. Field of the Invention

The present invention relates to an image forming apparatus such as a thermal printer that uses a thermal head and to a method for correcting the energizing time data for heating elements in the thermal printer.

2. Description of the Prior Art

There have recently been developed image forming apparatuses adapted to print printing data (YMC data) obtained by converting and expanding image data (RGB data) from a digital still camera (digital camera). Since YMC data is composed of tone data, it is suitable to use an image forming apparatus having high tone reproducibility. Hence, there have been developed thermal transfer type image forming apparatuses (e.g. thermal printers) that are considered to have higher tone reproducibility relative to inkjet type image forming apparatuses.

In general, inkjet type image forming apparatuses have only two alternative values whether or not to fire an ink droplet onto one pixel. Therefore, in such image forming apparatuses, small ink droplets are to be placed on paper to try to ensure resolution and reproducibility through an error diffusion method, etc. On the contrary, in thermal transfer type image forming apparatuses (e.g. thermal printers), controlling the heat quantity to be applied in a recording operation allows the number of tones for one pixel to be increased.

Thermal printers commonly comprise a thermal head (line head) with more than thousands of heating elements (dot heating elements) arranged thereon in line (in the main scanning direction). Then, the thermal head is adapted to heat an ink film to transfer colorant (ink) of the ink film onto receiver paper (sheet) that is carried. Therefore, the amount of ink to be transferred to a sheet fluctuates in accordance with the heat quantity of the thermal head, and the fluctuation is utilized to form an image with rich tones on the sheet.

Accordingly, controlling the temperature (heat quantity) of the thermal head becomes an important factor to improve tone reproducibility for printing data. To be more concrete, it becomes important to control the energizing time for the thermal head.

For example, the thermal printer described in Japanese Patent Laid-Open Publication No. Hei 7-52436 (refer to FIGS. 2 and 3, etc.) performs a corrective operation in consideration of "the effect of adjacent heat (adjacent heat effect)" from the two left and right dots (four dots in total: $B_n$, $C_n$, $E_n$, and $F_n$) of a target heating element $D_n$ (one dot) and "the effect of heat history (heat history effect)" from the five dots ($B_{n-1}$, $C_{n-1}$, $D_{n-1}$, $E_{n-1}$, and $F_{n-1}$) in the first preceding line as shown in FIG. 15, and then controls the energizing time for the thermal head.

Such a corrective operation (correction) is performed to prevent a situation where the adjacent heat effect and the heat history effect cause the density of the dot corresponding to the heating element $D_n$ to be increased when the heating element $D_n$ is simply energized for normal time (non-corrective normal time) based on YMC data.

That is, in consideration of the adjacent heat effect and the heat history effect, the printer is controlled so as to give a desired density by making the energizing time for the heating element $D_n$ shorter than the normal time (non-corrective normal time) and thereby subtracting remaining heat energy from the original heat energy that is to be given based on YMC data.

To make a detailed description with reference to FIG. 16, the printer is controlled so as to subtract remaining heat energy (corresponding to the adjacent heat effect and the heat history effect) from the energy applied for the normal time (non-corrective normal time).

Also, in Japanese Patent Laid-Open Publication No. Hei 6-255141 (refer to claim 1, etc.), in order to subtract remaining heat energy as mentioned above, there is provided a temperature sensor for measuring the temperature of the thermal head and a cooling fan is adapted to send air toward the thermal head based on the measurement result of the temperature sensor.

However, the thermal printer described in Japanese Patent Laid-Open Publication No. Hei 7-52436 takes adjacent heat effect into much consideration in the last phase of energizing time (in the end of energizing time) for one dot as shown in FIG. 16. That is, the energizing time in the last phase of energizing time for one dot is shortened to prevent the temperature of the thermal head from being increased excessively.

Therefore, if remaining heat energy (corresponding especially to the adjacent heat effect) may be subtracted excessively from the energy applied for the normal time, the temperature of the thermal head is to be reduced too much when printing the next line (refer to FIG. 15), resulting in a possibility of reducing the density of the next line.

Also, in the case where a cooling fan sends air toward the thermal head to subtract remaining heat energy stored in the thermal head as in the thermal printer described in Japanese Patent Laid-Open Publication No. Hei 6-255141, there is a possibility that the thermal head may be cooled excessively. In this case, the temperature of the thermal head is to be reduced too much when printing the next line (refer to FIG. 15), resulting in a possibility of reducing the density of the next line, as is the case with the foregoing example.

SUMMARY OF THE INVENTION

The present invention has been made to solve the above-described problems, and an object thereof is to provide a thermal printer (image forming apparatus) in which excessive temperature reduction of a thermal head is prevented and a method for controlling the energizing time for the thermal head (heating elements).

The present invention is directed to a thermal printer including a line head that has heating elements arranged in a first direction and adapted to energize and heat the heating elements based on energizing time data related to printing data to thermally transfer ink of an ink film onto a sheet that is carried in a second direction perpendicular to the first direction, the thermal printer comprising at least the following members:

- a first storage section for storing a heat history correction table that stores reference data related to first energizing time data and second energizing time data;
- a second storage section for storing at least the energizing time data for the current line to be printed, the energizing time data for the first preceding line printed immediately before the current line, and the energizing time data for the second preceding line printed immediately before the first preceding line; and
- a control section for obtaining energizing time data stored in the second storage section and for selecting reference data in the heat history correction table by assuming the energizing time data for a target dot in the current line as second energizing time data, while assuming the following energizing time data (1) to (3) as first energizing time data:

(1) energizing time data for both adjacent dots positioned on either side of the target dot;

(2) energizing time data for first-line adjacent dots constituting the first preceding line which are adapted to lie side-by-side, respectively, with the target dot and the both adjacent dots along the second direction; and (3) energizing time data for second-line adjacent dots constituting the second preceding line which are adapted to lie side-by-side, respectively, with the first-line adjacent dots along the second direction.

Further, the control section performs a corrective operation for the energizing time data for the target dot in such a manner as to change the start of energization in the energizing time data for the target dot using the following reference data (a) to (c):

(a) reference data based on the energizing time data for the target dot and for the both adjacent dots;

(b) reference data based on the energizing time data for the target dot and for the first-line adjacent dots; and (c) reference data based on the energizing time data for the target dot and for the dot lying side-by-side with the target dot along the second direction among the second-line adjacent dots, while in such a manner as to change the end of energization in the energizing time data for the target dot using the following reference data (d):

(d) reference data based on the energizing time data for the target dot and for the dots lying side-by-side, respectively, with the both adjacent dots along the second direction among the second-line adjacent dots.

In the thermal printer according to the present invention, it is possible to reduce the effect of remaining heat energy by delaying the start of energization in the pre-correction energizing time data for a target dot (i.e. by shortening the energizing time). Meanwhile, it is possible to prevent a situation where the temperature of heating elements is reduced excessively when printing dots in the next line by delaying the end of energization in the pre-correction energizing time data (i.e. by adding energizing time).

BRIEF DESCRIPTION OF THE DRAWINGS

FIG. 8 is a timing chart showing an example of signals to be handled in the CPU;

FIG. 12 is a table illustrating a corrective operation process;

FIG. 14 is a view showing another example of FIG. 12;

DESCRIPTION OF THE PREFERRED EMBODIMENTS

First Embodiment

Figure 2:
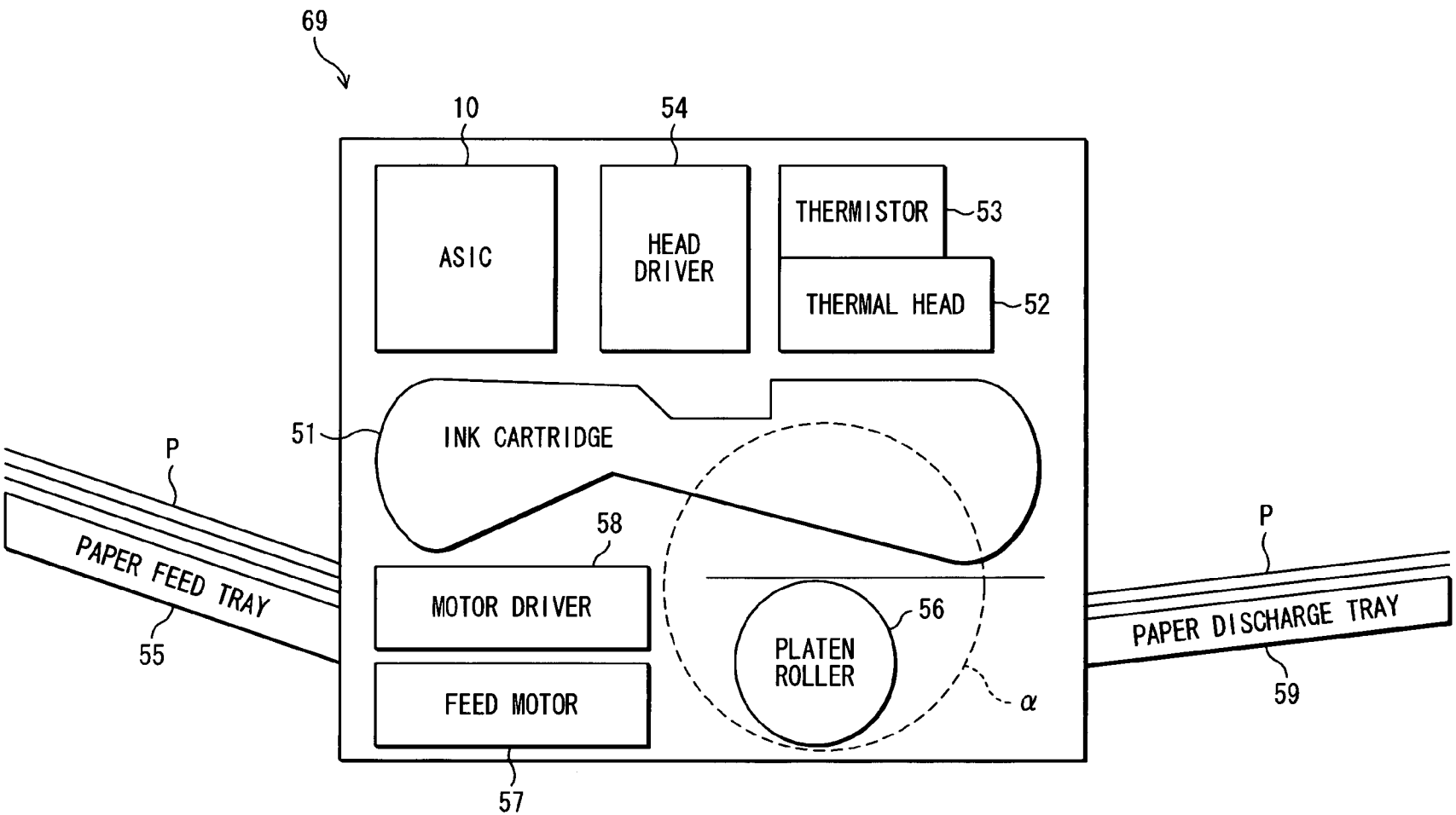
FIG. 2 is a schematic block diagram of a thermal printer according to the present invention.
Figure 3:
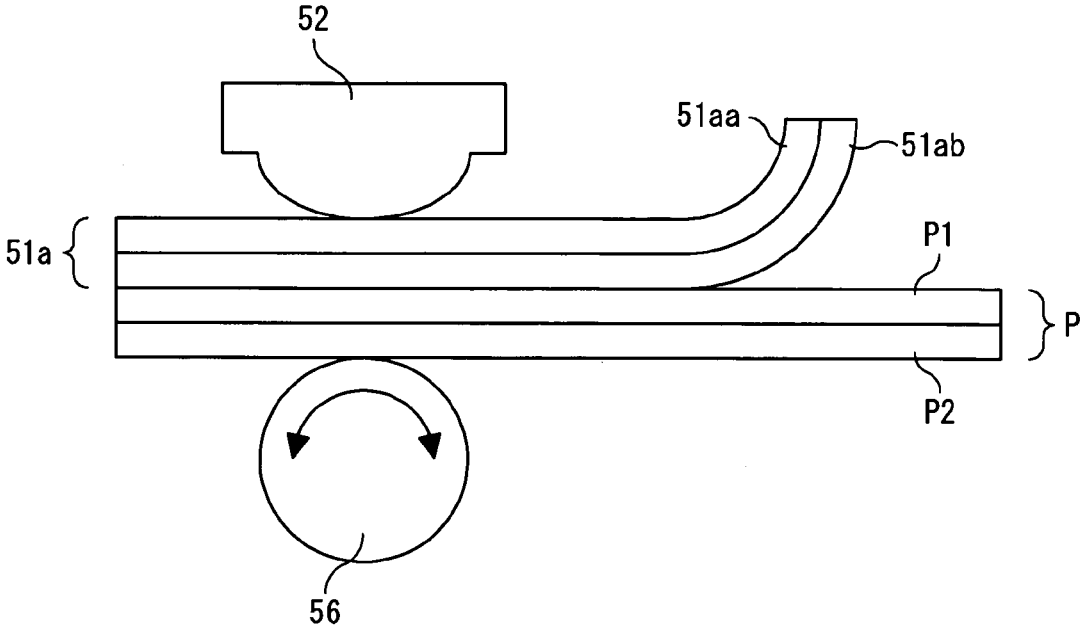
FIG. 3 is an enlarged view of the part "□" in FIG. 2.
Figure 4:
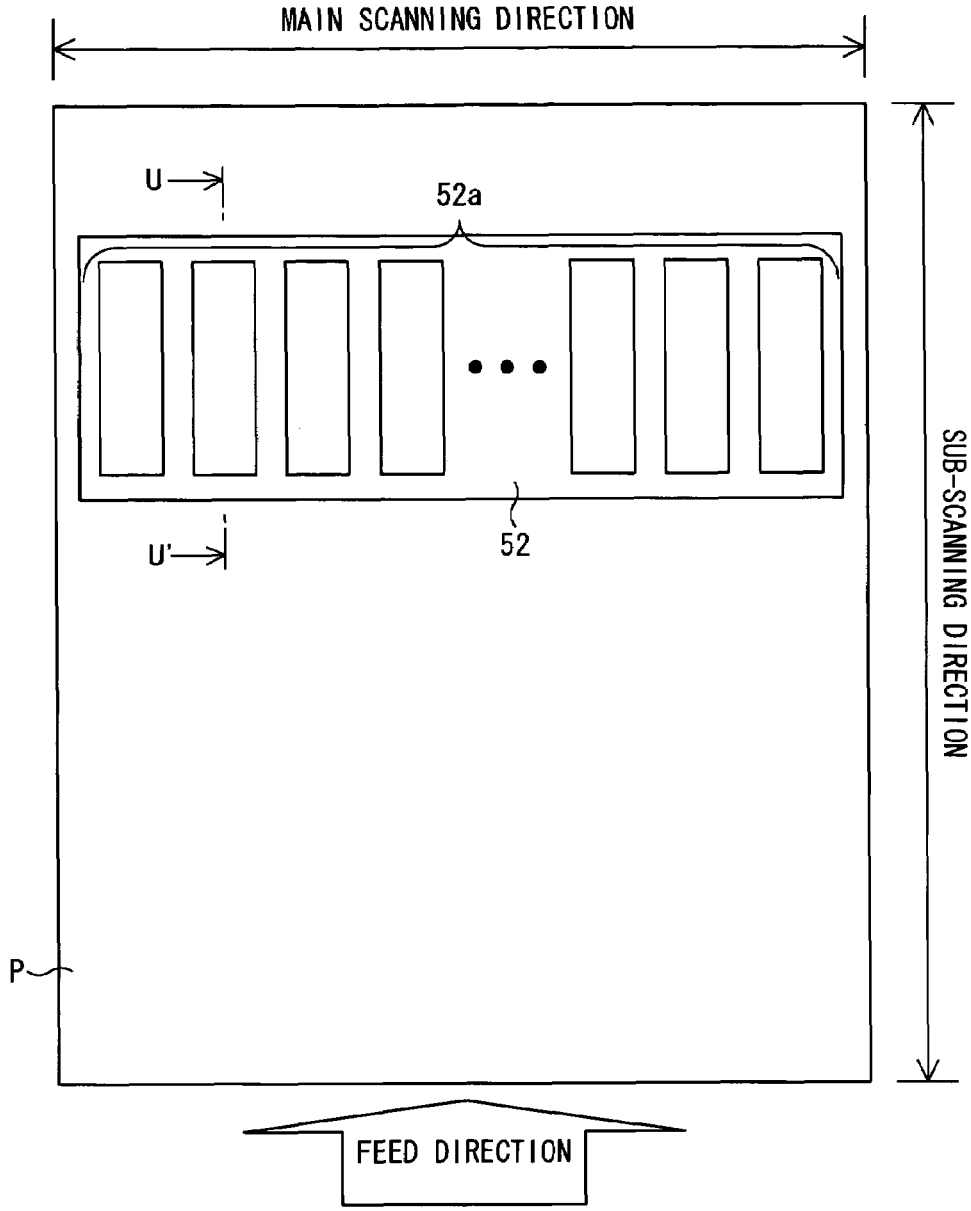
FIG. 4 is an illustrative view showing the positional relationship between the direction in which a sheet flows and a thermal head.
Figure 5:
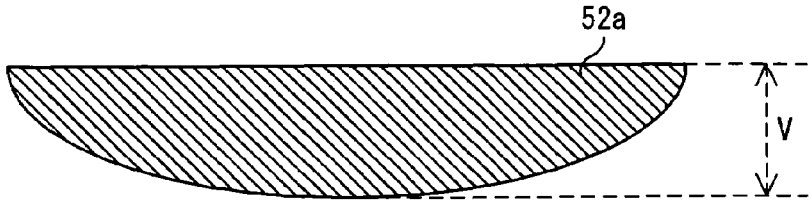
FIG. 5 is a cross-sectional view along the line U-U' in FIG. 4.

One embodiment of the present invention will hereinafter be described with reference to the accompanying drawings. FIG. 2 is a schematic block diagram of a thermal transfer type dye sublimation thermal printer (image forming apparatus) 69 according to the present invention, and FIG. 3 is an enlarged schematic block diagram of the part "□" in FIG. 2. Then, FIG. 4 is a view showing the positional relationship between the direction in which a sheet P flows (feed direction in a printing operation) and a thermal head 52, and FIG. 5 shows a cross-sectional shape (cross-sectional view along the line U-U') of each heating element 52*a* in FIG. 4

[1. Schematic Configuration of the Thermal Printer]

The thermal printer 69 according to the present invention and shown in FIGS. 2 and 3 is arranged to include at least an ink cartridge 51, a thermal head 52, a thermistor 53, a head driver 54, a paper feed tray 55, a platen roller 56, a feed motor 57, a motor driver 58, a paper discharge tray 59, and an ASIC (Application Specific Integrated Circuit) 10.

In the ink cartridge 51 are housed each rolled-up ink film 51*a* (specifically, a yellow ink film (Y film), a magenta ink film (M film), and a cyan ink film (C film); refer to FIG. 3) and an overcoat film (OC film) for protecting the sheet P side by side.

It is noted that such an ink film 51*a* is arranged in such a manner that an ink layer 51*ab* is stacked on a base film 51*aa*. Also, the sheet P is preferably arranged in such a manner that a base material P2 is coated with an absorbing layer P1 to which ink of the ink layer 51*ab* is likely to thermally transfer, though may be one like normal paper.

As shown in FIG. 4, the thermal head (line head) 52 has heating elements (dot heating elements) 52*a* arranged in line. Then, the heat energy from the heating elements 52*a* is adapted to heat the ink film 51*a* and thereby to thermally transfer (dye sublimation type) the ink layer Slab onto the sheet P.

As shown in FIG. 3, it is noted that the both ends of the heating elements 52*a* are arranged in such a manner as to be bent back from the sheet P (printing surface) for example. That is, the cross-section has a semicircle (glaze) shape (i.e. having a rounded portion therein) as shown in FIG. 5 (cross-sectional view along the line U-U'). Also, the heating elements 52*a* each have a thickness (glaze thickness) V of about 200 □m.

The thermistor 53 is adapted to detect the temperature of the thermal head 52.

The head driver 54 incorporates an OS (Operating System) for driving the thermal head 52 therein.

The paper feed tray 55 is adapted to have a sheet P to be printed placed thereon.

The platen roller 56 is adapted to carry the sheet P so as to reach the ink cartridge 51 and to be driven by the feed motor (stepping motor) 57. It is noted that the thermal printer 69 according to the present invention is arranged in such a manner as to transfer ink of multiple colors to a sheet P repeatedly and further to make an overcoat. Therefore, the platen roller 56 and the feed motor 57 can be rotated in normal and reverse directions (refer to FIG. 3).

The motor driver 58 incorporates an OS for driving the feed motor 57 therein.

The paper discharge tray 59 is adapted to have a sheet P discharged outside the apparatus after a printing operation placed thereon.

It is noted that as shown in FIG. 4, the direction in which a sheet P is fed by the platen roller 56 (refer to FIG. 3) is referred to as sub-scanning direction (second direction; perpendicular to the first direction to be described hereinafter), while the direction in which the heating elements 52*a* are arranged is referred to as main scanning direction (first direction). Also, the feed direction is defined as the direction in which a sheet P is carried in a printing operation.

The ASIC 10 is an integrated circuit designed and fabricated for the use in the thermal printer 69 according to the present invention.

[2. Details of the ASIC and the Relationship Between the ASIC and External Devices]

Here will be described the details of the ASIC 10 and the relationship between the ASIC 10 and external devices with reference to the block diagram in FIG. 6.

<2-1. External Devices>

Figure 6:
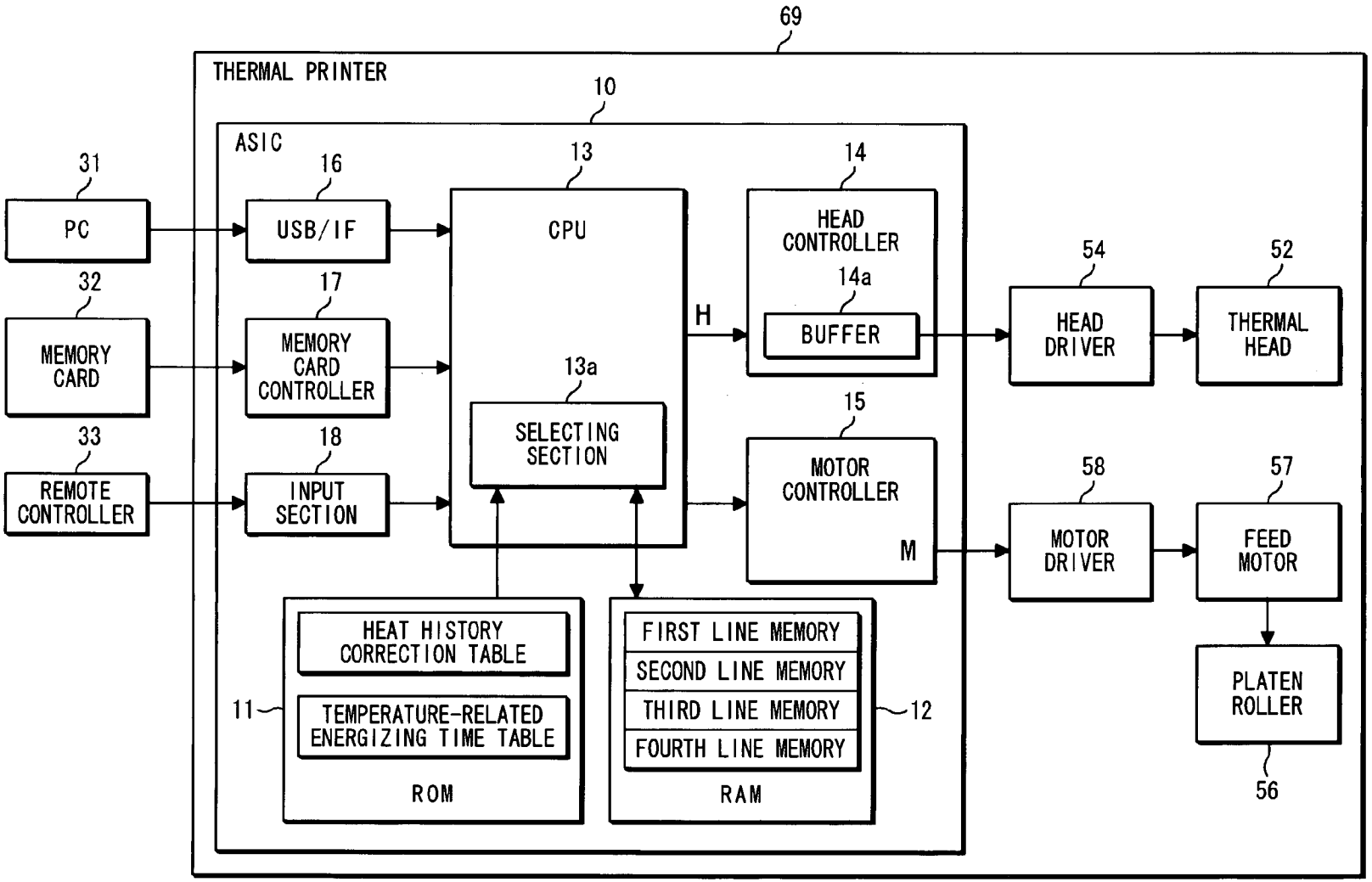
FIG. 6 is a block diagram showing members in the thermal printer according to the present invention.

First, as shown in FIG. 6, as external devices can be cited, for example, a PC (Personal Computer) 31 capable of making RGB data (image data), etc., a digital still camera (digital camera; not shown in the figure) for obtaining image data through photographing, a memory card 32 for storing image data, etc., and a remote controller 33 for selecting printing data obtained (e.g. printing data stored in a ROM 11 in the ASIC 10) through an operation.

Image data (RGB data) from these external devices is then adapted to be sent to a CPU 13 through a USB/IF (Universal Serial Bus/Interface) 16, a memory card controller 17, and an input section 18 provided in the ASIC 10.

<2-2. ASIC>

The ASIC 10 is arranged to include at least a ROM (Read Only Memory) 11, a RAM (Random Access Memory) 12, a CPU (Central Processing Unit) 13, a head controller 14, a motor controller 15, and the foregoing USB/IF 16, memory card controller 17, and input section 18.

<<2-2-1. ROM>>

The ROM (first storage section) 11 is adapted to store control programs and data, etc. for various operations according to the thermal printer 69. It is noted that thus storing data, etc. will be referred to as first storing step.

Figure 7:
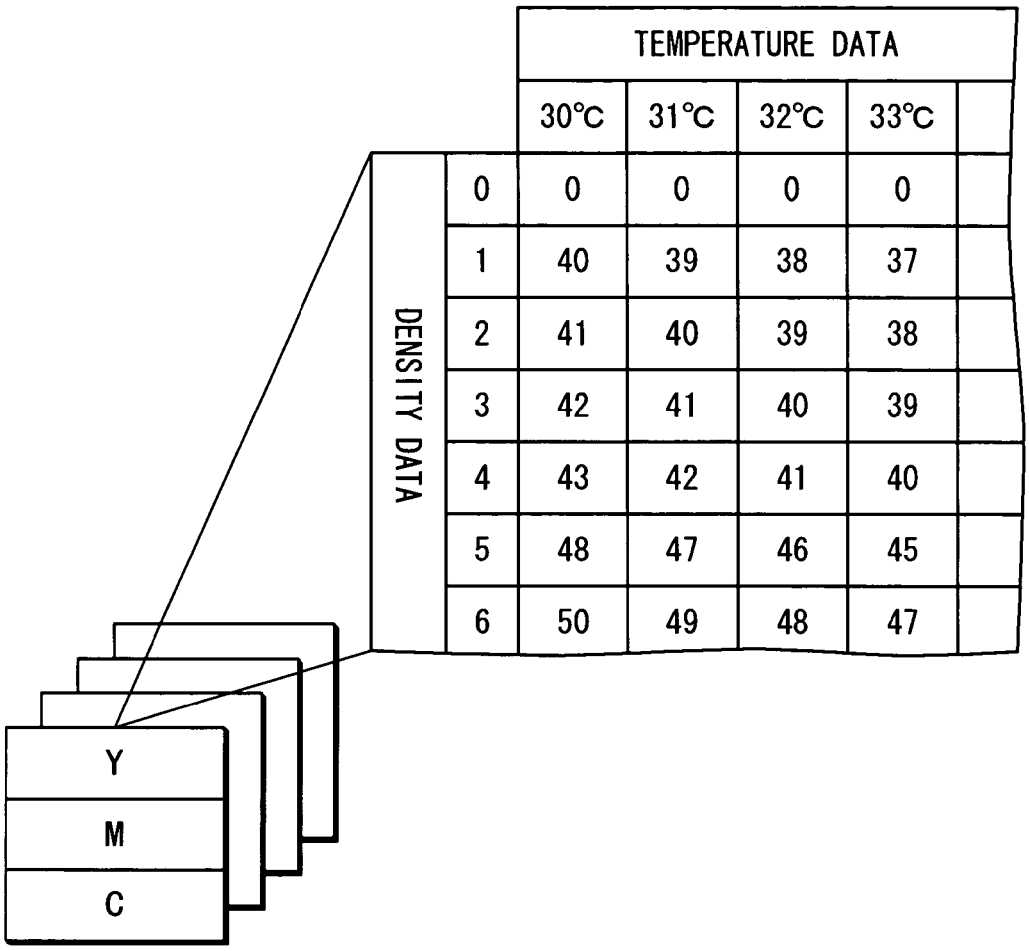
FIG. 7 is an illustrative view showing a temperature-related energizing time table.

Then, the ROM 11 stores at least a temperature-related energizing time table and a heat history correction table. As shown in FIG. 7, The temperature-related energizing time table, which is composed of energizing time data related to YMC data (density data) to be described hereinafter and temperature data of the thermistor 53, is stored for every 1° C. within the range of 30 to 60° C.

Figure 10:
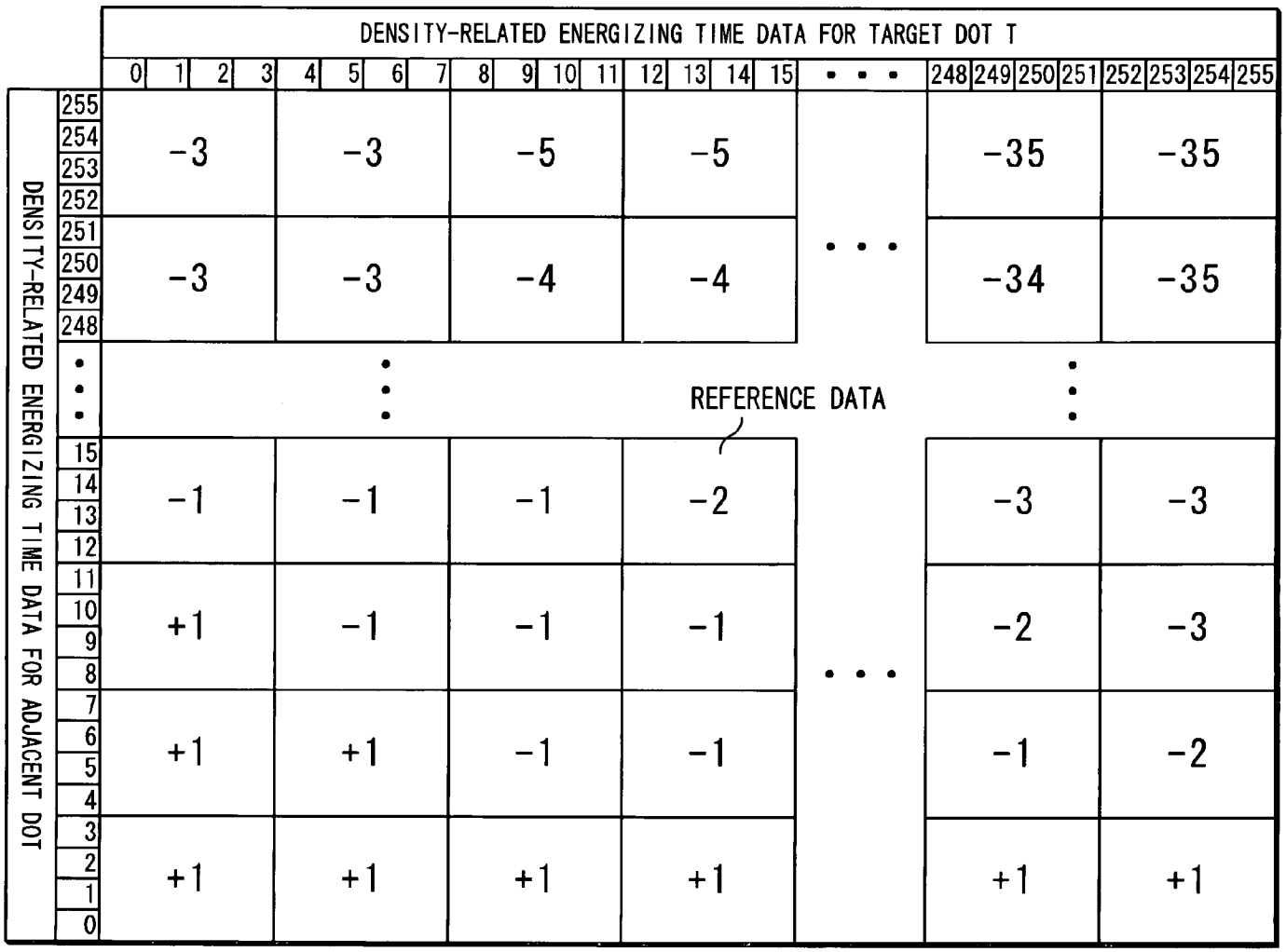
FIG. 10 is an illustrative view showing a heat history correction table.

As shown in FIG. 10 to be described hereinafter, the heat history correction table is composed of reference data related to density-related energizing time data (first energizing time data) for expressing the density of an adjacent dot and density-related energizing time data (second energizing time data) for expressing the density of a target dot T. It is noted that the heat history correction table will hereinafter be described in detail.

<<2-2-2. RAM>>

The RAM (second storage section) 12 is adapted to temporarily store image data provided from the external devices and result data of operations in the CPU 13. The thermal printer 69 according to the present invention is especially arranged to include at least four line memories (first to fourth line memories) (the details will hereinafter be described). It is noted that thus temporarily storing data, etc. will be referred to as second storing step.

<<2-2-3. CPU>>

The CPU (control section) 13 is adapted to perform various operations to generate a signal for controlling the operation of each part of the thermal printer 69. It is noted that thus performing various operations (corrective operations) will be referred to as operating step.

To be more concrete, the CPU 13 is adapted to handle at least a data signal (DATA), a clock signal (CLK), a latch signal (LTC), and a strobe signal (STB) as shown in FIG. 8. It is noted that in the timing chart shown in FIG. 8, signals that are difficult to illustrate are blacked out to be expressed.

The data signal (DATA) represents printing data (YMC data) obtaining by converting and expanding RGB data from an external device using, for example, a printing data converter circuit (not shown in the figure) in the CPU 13. It is noted that a signal (OC signal) for making an overcoat is also added to the data signal (DATA).

The clock signal (CLK) represents reference clock generated in, for example, a clock generator circuit (not shown in the figure) in the CPU 13.

The latch signal (LTC) represents a signal generated in, for example, a latch generator circuit (not shown in the figure) in the CPU 13, the signal being generated to control the timing of data signal (DATA) transfer. It is noted that in the present application is described the case of high active (active H) control for example.

The strobe signal (STB) represents a signal generated in, for example, a strobe generator circuit (not shown in the figure) in the CPU 13, the signal being adapted to allow the supply of driving power to (i.e. to control the energizing time for) the thermal head 52. It is noted that in the present application is described the case of low active (active L) control for example.

It is noted that the signals shown in FIG. 8 are for one (i.e. one dot in the main scanning direction) of a plurality of heating elements 52*a* included. Therefore, the time passage on the horizontal axis of the timing chart also represents the printing in the sub-scanning direction. Also, in the case of, for example, a thermal printer 69 capable of printing an A6-size sheet at 300 dpi, 1280 dots are required in the main scanning direction. Therefore, 1280 parallel data signals (DATA; 1280 bytes) are required.

Also, FIG. 8 (*a*) shows an entire data signal (DATA). That is, a data signal (DATA) is composed of a yellow signal, a magenta signal, a cyan signal, and an overcoat signal (OC signal).

It is noted that the yellow signal is a data signal (DATA) corresponding to the Y film, that the magenta signal is a data signal (DATA) corresponding to the M film, and that the cyan signal is a data signal (DATA) corresponding to the C film. Also, the OC signal is a data signal (DATA) corresponding to the OC film for protecting a sheet P with each color transferred thereto.

Further, FIG. 8 (*b*) is a timing chart of each signal related to the yellow signal in FIG. 8 (*a*). It is noted as mentioned above that the horizontal axis of the timing chart is considered to represent the printing in the sub-scanning direction. Therefore, in the case of, for example, a thermal printer 69 capable of printing an A6-size sheet at 300 dpi, 2000 dots are required in the sub-scanning direction. Therefore, there are 2000 Highs and Lows (H/Ls) in a strobe signal (STB).

FIG. 8 (*c*) is a timing chart of each signal related to a signal for one dot in FIG. 8 (*b*). Then, the thermal printer 69 according to the present invention is adapted to express one dot with 256 tones for example. Therefore, in the case of a printing operation at the maximum density (solid), there are 256 H/Ls in a latch signal (LTC).

Then, in the CPU 13, the selecting section 13*a* is adapted to generate a head control signal (H) (specifically, a post-correction head control signal (Hb) to be described hereinafter) for the head driver 54 and therefore the thermal head 52 from the data signal (DATA), clock signal (CLK), latch signal (LTC), and strobe signal (STB), etc (the details will hereinafter be described).

<<2-2-4. Head Controller>>

The head controller 14 shown in FIG. 6 is adapted to temporarily store a head control signal (H) sent from the CPU 13 in a buffer 14*a*, and then to send the signal to the head driver 54 and therefore the thermal head 52.

<<2-2-5. Motor Controller>>

The motor controller 15 is adapted to generate a motor control signal (M) for the motor driver 58 and therefore the feed motor 57.

[3. Correction of a Head Control Signal (H)]

<3-1. Conceptual Chart (FIG. 1)>

The thermal printer 69 according to the present invention is adapted to correct the printing time (density-related energizing time data) for one dot in FIG. 8 (*c*), that is, to correct a head control signal (H) to be sent to the head driver 54 shown in FIG. 6.

Figure 1:
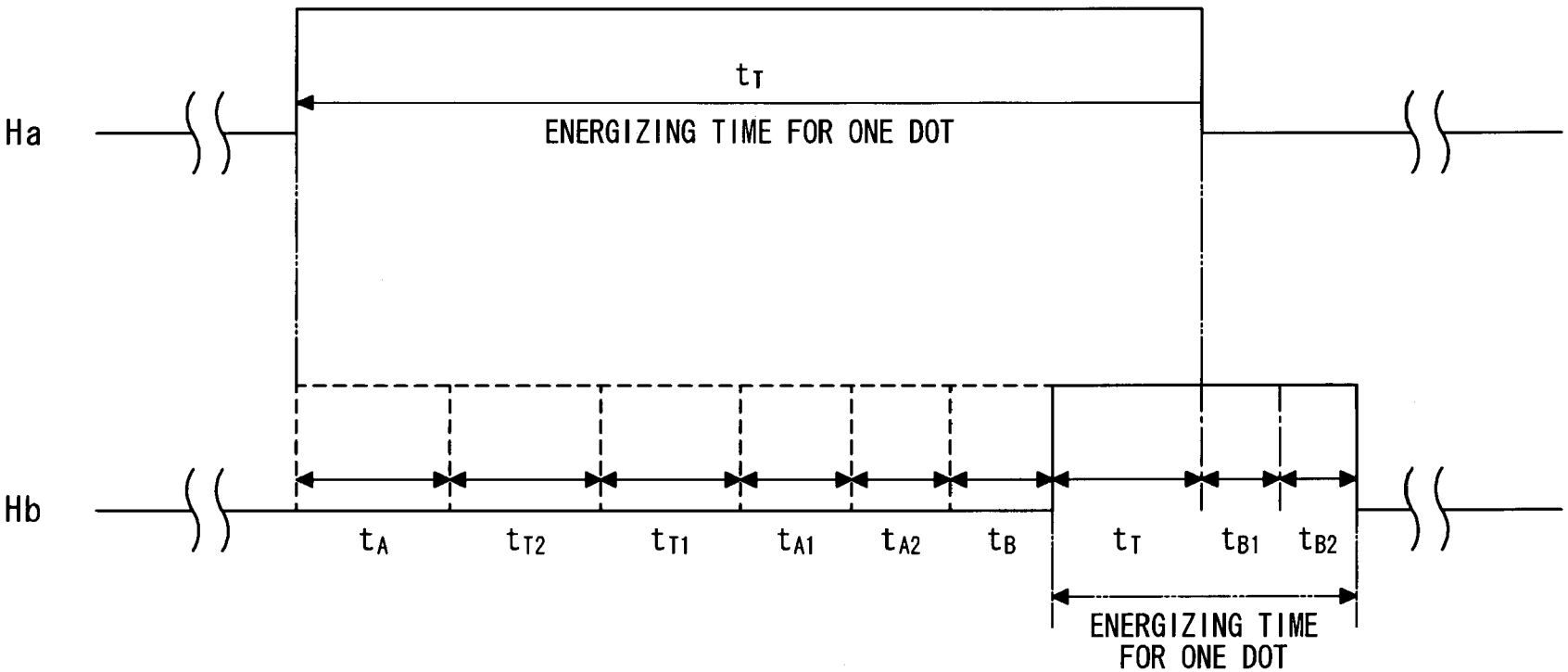
FIG. 1 is a timing chart showing the energizing time for a heating element to be corrected by the present invention.

Here, a conceptual chart of a head control signal (H) is shown in FIG. 1. The head control signal (H) represents energizing time data selected from the temperature-related energizing time table based on a data signal (DATA; YMC data). It is noted that a head control signal (H) before a correction will be referred to as pre-correction head control signal (Ha), while one after a correction as post-correction head control signal (Hb).

Figure 9:
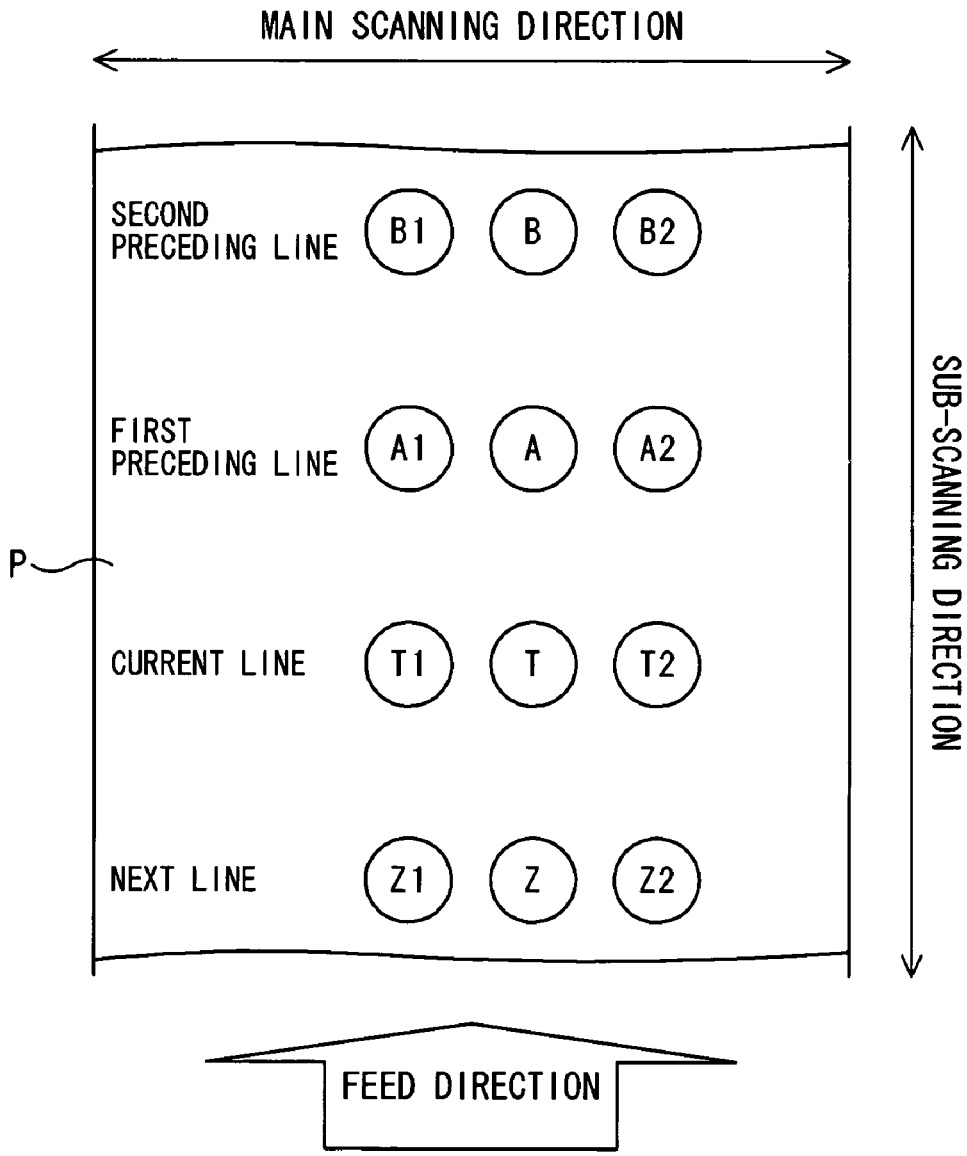
FIG. 9 is an illustrative view showing the positional relationship between dots.

In addition, the symbol "t" shown in FIG. 1 represents time (energizing time), and the symbols attached to "t" correspond to the respective dot positions shown in FIG. 9.

It is noted that FIG. 9 shows dot positions printed (or to be printed) when a sheet P is fed in a printing operation, and the dot position indicated by T represents a target dot T to be corrected. Then, the line including the dot T will be referred to as "current line (current-line data)".

Further, the line printed immediately before the current line will be referred to as "first preceding line (one-line preceding data)", and the line before it (i.e. printed immediately before the first preceding line) as "second preceding line (two-line preceding data)".

Then, to make a detailed description, the dot positions lying side-by-side with the target dot T along the sub-scanning direction in the first and second preceding lines are represented, respectively, by A and B. Also, the both adjacent dots of the dot A are referred to (defined) as A1 and A2, while the both adjacent dots of the dot B as B1 and B2. It is noted that the both adjacent dots of the target dot T are represented by T1 and T2.

Then, in the present application, T1, T2, A1, A, A2, B1, B, and B2 to be positioned around the target dot T are referred to as "adjacent dots".

Accordingly, the dots in the first preceding printed line (dots in the first preceding line; A1, A and A2) of the two lines (first and second preceding lines) printed immediately before the current line may be referred to also as adjacent dots that are to lie side-by-side, respectively, with the dots (T1, T, and T2) in the current line along the sub-scanning direction.

Also, the dots in the second preceding printed line (dots in the second preceding line; B1, B and B2) of the two lines (first and second preceding lines) printed immediately before the current line may be referred to also as adjacent dots that are to lie side-by-side, respectively, with the dots (T1, T, and T2) in the current line along the sub-scanning direction.

To make a more detailed description, it may also be considered that the dot B is to lie side-by-side with the target dot T along the sub-scanning direction (i.e. face along the sub-scanning direction), while that the dots B1 and B2 are to lie side-by-side, respectively, with the both adjacent dots (T1 and T2) of the target dot T along the sub-scanning direction (i.e. face along the sub-scanning direction).

<3-2. Various Aspects in the Correction of a Head Control Signal (H)>

Meanwhile, as shown in the conceptual chart of FIG. 1, the thermal printer 69 according to the present invention does not try to heat the thermal head 52 based on normal energizing time (printing time) $t_T$ (i.e. pre-correction head control signal (Ha)), but to make a correction to give a post-correction head control signal (Hb). This is for the reason that printing using a pre-correction head control signal (Ha) results in a reproduction of a density higher than desired due to remaining heat energy.

Although conventional thermal printers also take remaining heat energy into consideration and make a correction (shortening correction) of energizing time, the present invention provides time ($t_{B1}$ and $t_{B2}$) for preheating the thermal head 52 to prevent the temperature of the thermal head 52 from being reduced due to shortening correction.

That is, the energizing time for one dot is obtained not only by shortening energizing time such as $t_A$, $t_{T2}$, $t_{T1}$, $t_{A1}$, $t_{A2}$, and $t_B$ in FIG. 1 but also by adding preheating time ($t_{B1}$ and $t_{B2}$). It is noted that the time obtained by subtracting $t_A$, $t_{T2}$, $t_{T1}$, $t_{A1}$, $t_{A2}$, and $t_B$ from the normal energizing time $t_T$ will be represented by $t'_T$ ($t'_T = t_T - (t_A + t_{T2} + t_{T1} + t_{A1} + t_{A2} + t_B)$).

<3-3. Heat History Correction Table>

Here will be described the heat history correction table, which is required to make a correction of a head control signal (H), with reference to FIG. 10. As shown in FIG. 10, the heat history correction table is a matrix table in which data that indicates energizing time required to express the density of the target dot T (density-related energizing time data; $2^8$-bit (1-byte) data from 0 to 255) and density-related energizing time data (1-byte data from 0 to 255) of an adjacent dot are related to each other. Then, the heat history correction table as a matrix table is composed of $2^8$-bit (1-byte) data (reference data) from −128 to +127.

It is noted that the density-related energizing time data of an adjacent dot represents data at a dot position (B1, B, or B2) in the second preceding line, a dot position (A1, A, or A2) in the first preceding line, or a dot position (T1 or T2)

on one side of the target dot T in the current line in FIG. 9. It is also noted that T1 and T2 may be referred to as both adjacent dots.

<3-4. Corrective Calculation (Correction of One Dot and One Line)>

Here will exemplarily be described the correction to be performed by the thermal printer 69 according to the present invention, that is, the calculation (operation) for obtaining the post-correction head control signal (Hb) shown in FIG. 1 using reference data that constitutes a heat history correction table.

Figure 11:
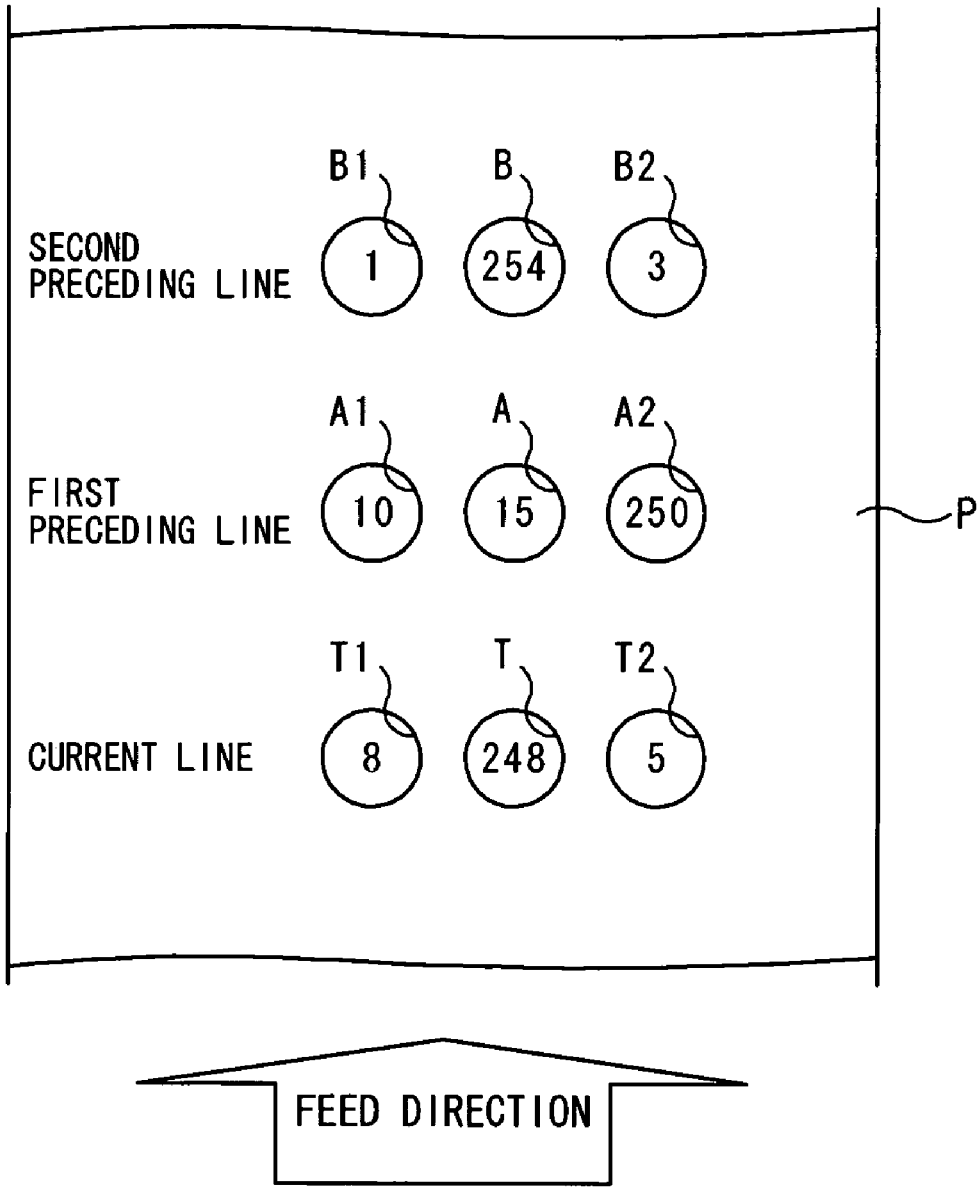
FIG. 11 is an illustrative view showing density-related energizing time data at each dot position.

For example, there is a case where the target dot T has density-related energizing time data of 248 as shown in FIG. 11. In this case, in order to reproduce density-related energizing time data of 248, a pre-correction head control signal (Ha; i.e. energizing time for one dot required to reproduce density-related energizing time data of 248) is required.

However, printing using the pre-correction head control signal (Ha) results in a reproduction of a higher density due to remaining heat energy as mentioned above. Therefore, it is desired to generate a post-correction head control signal (Hb) taking remaining heat energy into consideration.

Hence, the thermal printer 69 according to the present invention obtains a post-correction head control signal (Hb) through the method described below.

It is noted that density-related energizing time data to be used in the corrective operation is the energizing time data that is related to YMC data (printing data), which is to be selected from a temperature-related energizing time table by the CPU 13.

The CPU 13 is also adapted to store, for example, the following data in each line memory of the RAM 12:

1) density-related energizing time data before a correction for the current line (pre-correction current line data);
2) density-related energizing time data after a correction for the second preceding line (second preceding line data);
3) density-related energizing time data after a correction for the first preceding line (first preceding line data); and
4) density-related energizing time data after a correction for the current line (post-correction current line data).

Then, the description below will use the tables shown in FIGS. 10, 11 and 12 to make it easy to understand the calculation process.

First, as shown in FIG. 12 (*a*), the selecting section 13*a* of the CPU 13 selects the density-related energizing time data before a correction for the target dot T (248) and the both adjacent dots T1 (8) and T2 (5) from the current line data stored in the RAM 12 (line memory).

Next, as shown in FIG. 12 (*b*), the selecting section 13*a* of the CPU 13 selects the density-related energizing time data for the adjacent dots (selects the density-related energizing time data for A (15), A1 (10), A2 (250), B (254), B1 (1), and B2 (3)) from the post-correction second preceding line data and the post-correction first preceding line data stored in the RAM 12 (line memory).

Then, as shown in FIG. 12 (*c*), the selecting section 13*a* of the CPU 13 compares the density-related energizing time data for the target dot T (248) with that of the adjacent dots (T1 (8), T2 (5), A (15), A1 (10), A2 (250), B (254), B1 (1), and B2 (3)) and then selects reference data based on the heat history correction table (refer to FIG. 10) stored in the ROM 11.

To be more concrete, reference data to be selected is as follows (refer to FIGS. 12 (*c*) and 1):

T-T1□ −2 [$t_{T1}$ (−2)];
T-T2□ −1 [$t_{T2}$ (−1)];
T-A□ −3 [$t_A$ (−3)];
T-A1□ −2 [$t_{A1}$ (−2)];
T-A2□ −34 [$t_{A2}$ (−34)];
T-B□ −35 [$t_B$ (−35)];
T-B1□ +1 [$t_{B1}$ (+1)]; and
T-B2□ +1 [$t_{B2}$ (+1)].

Then, the reference data is added to and/or subtracted from 248 of the target dot T to calculate a post-correction head control signal (Hb).

To be more concrete, the selecting section 13*a* of the CPU 13 is adapted to subtract $t_A$ (−3), $t_{T2}$ (−1), $t_{T1}$ (−2), $t_{A1}$ (−2), $t_{A2}$ (−34), and $t_B$ (−35) from the rising part (the start of energization) of the pre-correction head control signal (Ha) shown in FIG. 1 to obtain $t'_T$ (171), and to add $t_{B1}$ (+1) and $t_{B2}$ (+1) (to add $t_{B1}$ (+1) and $t_{B2}$ (+1) to the falling part (the end of energization) of the pre-correction head control signal (Ha)) to obtain a post-correction head control signal (Hb) ($t'_T+t_{B1}+t_{B2}=173$; density-related energizing time data).

The selecting section 13*a* of the CPU 13 is then adapted to obtain such a post-correction head control signal (Hb) for one dot for one line, and to store thus obtained post-correction head control signals (Hb) for one line in a line memory of the RAM 12 as mentioned above.

Then, the CPU 13 is adapted to send thus stored post-correction head control signals (Hb) for one line to the buffer 14*a* of the head controller 14.

<3-5. Corrective Calculation (Correction of All Lines)>

It is noted that the repetition of such a post-correction head control signal (Hb) for one dot and for one line allows post-correction head control signals (Hb) for all lines to be obtained. The process will be described with reference to the flow chart in FIG. 13. It is noted that each step in the flow chart will be represented by S.

Figure 13:
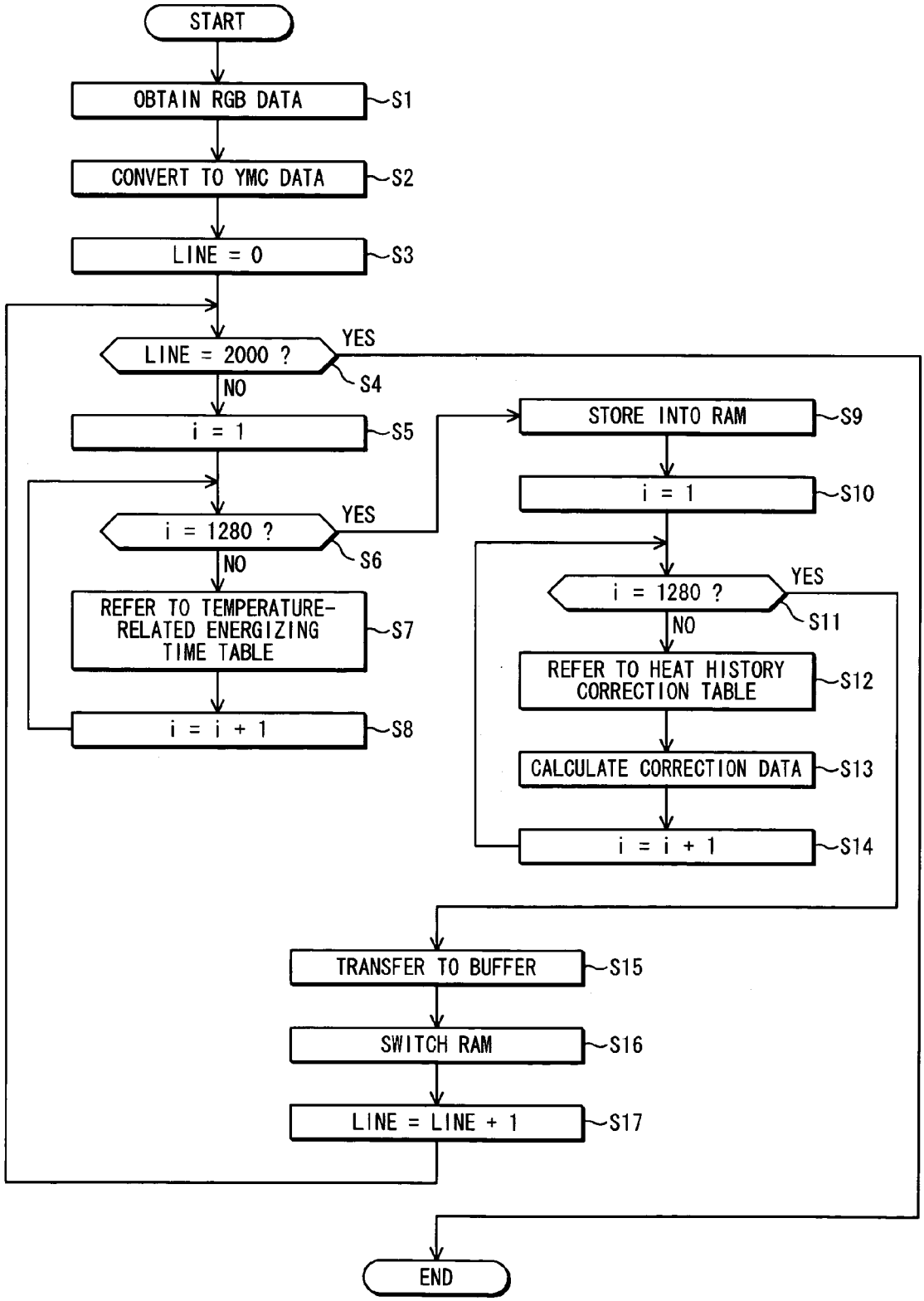
FIG. 13 is a flow chart showing a process of making a correction for all lines.
Figure 15:
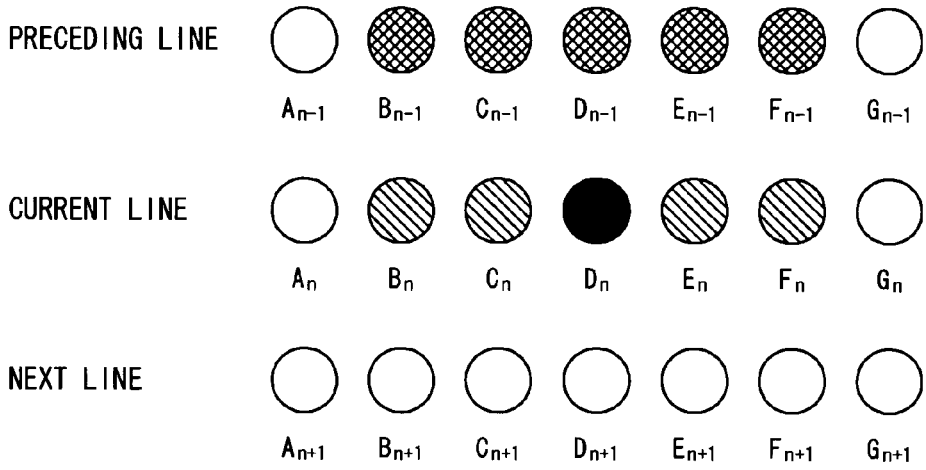
FIG. 15 is a view illustrating a conventional correction.
Figure 16:
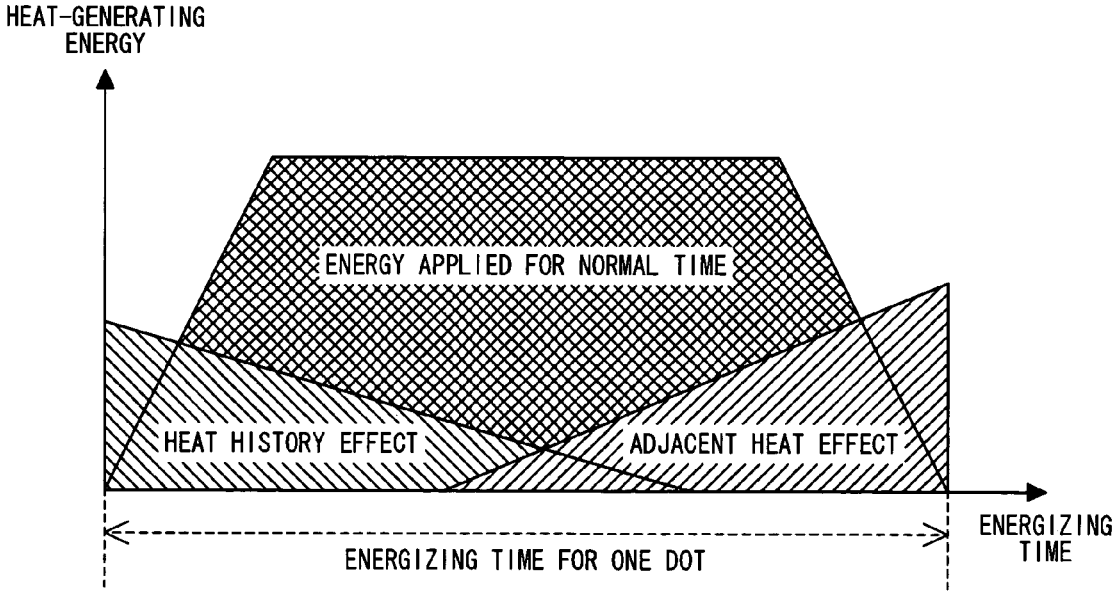
FIG. 16 is an illustrative view showing an energetic relationship in the conventional correction.

As shown in the flow chart in FIG. 13, after the CPU 13 first obtains RGB data from, for example, the memory card 32 (S1), the RGB data is converted and expanded to YMC data by the printing data converter circuit (not shown in the figure) (S2).

The CPU 13 then defines the initial line (first line in the sub-scanning direction) as "0" (S3), and confirms that the selected line is not a final line (last line in the sub-scanning direction; e.g. 2000th line) (S4). Then, if not a 2000th line, the CPU 13 defines the initial dot in the selected line in the main scanning direction as "i=1" (S5), and confirms that the selected dot is not a final dot in the main scanning direction (e.g. 1280th dot) (S6).

Then, if not a 1280th dot, the CPU 13 selects energizing time data related to YMC data of the selected dot using the temperature-related energizing time table stored in the ROM 11 (S7). The CPU 13 is then adapted to obtain energizing time data through the final dot in the selected line (i.e. repeat the steps S8□S6□S7□S8).

Then, if energizing time data for all the dots in the selected line has been obtained, the CPU 13 stores the energizing time data for one line (i.e. pre-correction head control signal (Ha)) in the RAM 12 (S9).

Next, the CPU 13 defines the initial dot in the selected line in the main scanning direction as "i=1" (S10), and confirms that the selected dot is not a final dot in the main scanning direction (S1), as is the case with the foregoing steps. Then, if not a 1280th dot, the CPU 13 uses the heat history correction table stored in the RAM 12 (S12) to perform a corrective operation for the density-related energizing time data (pre-correction head control signal (Ha)) for the selected dot (i.e. target dot T) to be a post-correction head control signal (Hb) (S13).

The CPU 13 is then adapted to obtain post-correction head control signals (Hb) through the final dot in the selected line (i.e. repeat the steps S14□S11□S12□S13□S14).

Then, if post-correction head control signals (Hb) for all the dots in the selected line have been obtained, the CPU 13 sends the post-correction head control signals (Hb) for one line to the buffer 14*a* to be stored therein (S15). The post-correction head control signals (Hb) for one line are also to be stored in the RAM 12.

Then, the CPU 13 is adapted to switch the post-correction head control signals (Hb) for the first preceding line stored in the RAM 12 to the post-correction head control signals (Hb) for the second preceding line, while the post-correction head control signals (Hb) for the current line to the post-correction head control signals (Hb) for the first preceding line (S16).

The CPU 13 is then adapted to make a correction of all the lines in the sub-scanning direction (S17□S4).

It is noted that the steps S10 to S14 (including the repetition of S11 to S14) in the flow chart shown in FIG. 13 are also considered to describe such a correction of one dot and one line.

[4. Various Aspects of the Present Invention]

As described heretofore, the thermal printer 69 according to the present invention includes a thermal head (line head) 52 that has heating elements 52*a* arranged in the main scanning direction (first direction) and is adapted to energize and heat the heating elements 52*a* based on energizing time data (density-related energizing time data) related to printing data (YMC data) to thermally transfer ink of an ink film 51*a* onto a sheet P that is carried in the sub-scanning direction (second direction) perpendicular to the main scanning direction.

Then, the thermal printer 69 comprises at least a ROM (first storage section) 11, a RAM (second storage section) 12, and a CPU (control section) 13.

The ROM 11 then stores a heat history correction table that stores reference data related to the density-related energizing time data for adjacent dots (first energizing time data) and the density-related energizing time data for a target dot T (second energizing time data).

Also, the RAM 12 stores at least the energizing time data for the current line to be printed (pre-correction current line data), the energizing time data for the first preceding line printed immediately before the current line (first preceding line data), and the energizing time data for the second preceding line printed immediately before the first preceding line (second preceding line data).

Further, the CPU 13 is adapted to obtain the density-related energizing time data for the first and second preceding lines (first and second preceding lines data) and the density-related energizing time data of pre-correction current line data for the current line to be printed stored in the RAM 12 and to select reference data in the heat history correction table by assuming the density-related energizing time data for the first and second preceding lines as the density-related energizing time data for adjacent dots, while assuming the density-related energizing time data of the pre-correction current line data for the current line to be printed as the density-related energizing time data for the target dot T.

To be more concrete, the density-related energizing time data before a correction for the target dot T in the current line to be printed is assumed as the density-related energizing time data for the target dot T as it is in the heat history correction table. Meanwhile, the following density-related energizing time data (1) to (3) is assumed as the density-related energizing time data for adjacent dots in the heat history correction table to select reference data:

(1) density-related energizing time data for both adjacent dots T1 and T2 of the target dot T (e.g. density-related energizing time data before a correction);

(2) density-related energizing time data for dots A, A1 and A2 (first-line adjacent dots) in the first preceding line (first preceding printed line) of the two lines printed immediately before the current line which are adapted to lie side-by-side, respectively, with the target dot T and the both adjacent dots T1 and T2 along the sub-scanning direction; and (3) density-related energizing time data for dots B, B1 and B2 (second-line adjacent dots) in the second preceding line (second preceding printed line) of the two lines printed immediately before the current line which are adapted to lie side-by-side, respectively, with the dots A, A1 and A2 along the sub-scanning direction.

Further, the CPU 13 uses thus selected reference data to perform a corrective operation for the density-related energizing time data before a correction for the current line to be printed (in more detail, the density-related energizing time data before a correction for the target dot T in the current line to be printed) and thereby to calculate the energizing time data for the target dot T in the current line (post-correction head control signal (Hb) for the target dot T constituting the post-correction current line data).

To be more concrete, the CPU 13 performs a corrective operation in such a manner as to change the start of energization in the density-related energizing time data before a correction for the target dot T (refer to FIG. 1) using the following reference data (a) to (c):

(a) reference data based on the density-related energizing time data before a correction for the target dot T and for the both adjacent dots T1 and T2;

(b) reference data based on the density-related energizing time data before a correction for the target dot T and for the dots A, A1 and A2 (first-line adjacent dots); and (c) reference data based on the density-related energizing time data before a correction for the target dot T and for the dot B lying side-by-side with the target dot T among the dots B, B1 and B2 (second-line adjacent dots), while in such a manner as to change the end of energization in the density-related energizing time data before a correction for the target dot T using the following reference data (d):

(d) reference data based on the density-related energizing time data before a correction for the target dot T and for the dots B1 and B2 lying side-by-side, respectively, with the both adjacent dots T1 and T2 among the dots B, B1 and B2 (second-line adjacent dots).

That is, the thermal printer 69 according to the present invention uses the ROM 11, RAM 12, and CPU 13 to delay the start and also the end of energization in the pre-correction head control signal (Ha; density-related energizing time data) in the conceptual chart of FIG. 1

Thus, in the thermal printer 69 according to the present invention, it is possible to reduce the effect of remaining heat energy by delaying the start of energization in the pre-correction head control signal (Ha) (i.e. by shortening the energizing time). Meanwhile, it is possible to prevent a situation where the temperature of the thermal head 52

(heating elements 52*a*) is reduced excessively when printing dots in the next line by delaying the end of energization in the pre-correction head control signal (Ha) (i.e. by adding energizing time).

OTHER EMBODIMENTS

It is noted that the present invention is not restricted to the above-described embodiment, and various modifications may be made without departing from the gist of the present invention.

For example, in the process of making a correction of one dot and one-line preceding data, the density-related energizing time data for the dot T1 is corrected using "8", a pre-correction head control signal (Ha), in the above-described embodiment as shown in FIG. 12. However, since the dot T1 has already been corrected when correcting the dot T, a post-correction head control signal (Hb) for the dot T1 (e.g. "3") may be used to correct the dot T.

To be more concrete, as shown in FIG. 14 (*a*), the selecting section 13*a* of the CPU 13 selects the density-related energizing time data for the target dot T (248) and for one of the both adjacent dots T2 (5) from the pre-correction current line data stored in the RAM 12 (line memory).

Next, as shown in FIG. 14 (*b*), the selecting section 13*a* of the CPU 13 selects the density-related energizing time data for the other of the both adjacent dots T1 (T1 (3)) from the post-correction current line data, and also selects the density-related energizing time data for the adjacent dots (selects the density-related energizing time data for A (15), A1 (10), A2 (250), B (254), B1 (1), and B2 (3)) from the post-correction second preceding line data and the post-correction first preceding line data stored in the RAM 12 (line memory).

Then, as shown in FIG. 14 (*c*), the selecting section 13*a* of the CPU 13 compares the density-related energizing time data for the target dot T (248) with that of the adjacent dots (T1 (3), T2 (5), A (15), A1 (10), A2 (250), B (254), B1 (1), and B2 (3)) and then selects reference data based on the heat history correction table (refer to FIG. 10) stored in the ROM 11.

To be more concrete, reference data to be selected is as follows (refer to FIGS. 14 (*c*) and 1):

T-T1□ +1 [$t_{T1}$ (+1)];
T-T2□ −1 [$t_{T2}$ (−1)];
T-A□ −3 [$t_A$ (−3)];
T-A1□ −2 [$t_{A1}$ (−2)];
T-A2□ −34 [$t_{A2}$ (−34)];
T-B□ −35 [$t_B$ (−35)];
T-B1□ +1 [$t_{B1}$ (+1)]; and
T-B2□ +1 [$t_{B2}$ (+1)].

Then, the reference data is added to and/or subtracted from 248 of the target dot T to calculate a post-correction head control signal (Hb).

To be more concrete, the selecting section 13*a* of the CPU 13 is adapted to subtract $t_A$ (−3), $t_{T2}$ (−1), $t_{T1}$ (+1), $t_{A1}$ (−2), $t_{A2}$ (−34), and $t_B$ (−35) from the rising part of the pre-correction head control signal (Ha) shown in FIG. 1 to obtain $t'_T$ (174), and to add $t_{B1}$ (+1) and $t_{B2}$ (+1) to obtain a post-correction head control signal (Hb) ($t'_T+t_{B1}+t_{B2}=176$; density-related energizing time data).

It is noted that reference data in the heat history correction table mentioned above can be obtained from various functions (e.g. linear function and higher-order function).

It will also be appreciated that the present invention may be achieved by, for example, providing a storage medium with a software program code for achieving the functions of the above-described embodiment recorded therein to the thermal printer 69, and then reading and executing the program code stored in the storage medium through a computer (e.g. CPU) in the thermal printer 69.

In the case above, the program code read out of the storage medium itself is to achieve the functions of the above-described embodiment, and thus the storage medium storing the program code is to constitute the present invention.

It is noted that as a storage medium for providing a program code can be used, for example, a floppy disk, hard disk, optical disk, magneto-optical disk, CD-ROM, CD-R, magnetic tape, nonvolatile memory card, or ROM.

It will also be appreciated that there is included not only the case where the functions of the above-described embodiment are achieved by executing a program code read by a computer, but also the case where an OS (Operating System), etc. running on the computer performs part or all of the actual processing based on the instructions of the program code to achieve the functions of the above-described embodiment.

It will further be appreciated that there is also included the case where a program code read from a storage medium is written into a memory that is provided in an extender board inserted in the computer or an extender unit connected to the computer, and then a CPU, etc. provided in the extender board or the extender unit performs part or all of the actual processing based on the instructions of the program code to achieve the functions of the above-described embodiment.

What is claimed is:

1. A thermal printer including a line head that has heating elements arranged in a first direction and adapted to energize and heat said heating elements based on energizing time data related to printing data to thermally transfer ink of an ink film onto a sheet that is carried in a second direction perpendicular to said first direction, said thermal printer comprising:

a first storage section for storing a heat history correction table that stores reference data related to first energizing time data and second energizing time data;

a second storage section for storing at least the energizing time data for the current line to be printed, the energizing time data for the first preceding line printed immediately before the current line, and the energizing time data for the second preceding line printed immediately before the first preceding line; and a control section for obtaining energizing time data stored in said second storage section and for selecting reference data in said heat history correction table by assuming the energizing time data for a target dot in the current line as second energizing time data, while assuming the following energizing time data (1) to (3) as first energizing time data:

(1) energizing time data for both adjacent dots positioned on either side of said target dot;

(2) energizing time data for first-line adjacent dots constituting the first preceding line which are adapted to lie side-by-side, respectively, with said target dot and said both adjacent dots along said second direction; and (3) energizing time data for second-line adjacent dots constituting the second preceding line which are adapted to lie side-by-side, respectively, with said first-line adjacent dots along said second direction, and further for performing a corrective operation for the energizing time data for said target dot in such a manner as to change the start of energization in the energizing time data for said target dot using the following reference data (a) to (c):

(a) reference data based on the energizing time data for said target dot and for said both adjacent dots;

(b) reference data based on the energizing time data for said target dot and for said first-line adjacent dots; and (c) reference data based on the energizing time data for said target dot and for the dot lying side-by-side with said target dot along said second direction among said second-line adjacent dots, while in such a manner as to change the end of energization in the energizing time data for said target dot using the following reference data (d):

(d) reference data based on the energizing time data for said target dot and for the dots lying side-by-side, respectively, with said both adjacent dots along said second direction among said second-line adjacent dots.

2. A thermal printer including a line head that has heating elements arranged in a first direction and adapted to energize and heat said heating elements based on energizing time data related to printing data to thermally transfer ink of an ink film onto a sheet that is carried in a second direction perpendicular to said first direction, said thermal printer comprising:

a first storage section for storing a heat history correction table that stores reference data related to first energizing time data and second energizing time data;

a second storage section for storing at least the energizing time data for the current line to be printed, the energizing time data for the first preceding line printed immediately before the current line, and the energizing time data for the second preceding line printed immediately before the first preceding line; and a control section for obtaining energizing time data stored in said second storage section and for selecting reference data in said heat history correction table by assuming the energizing time data for a target dot in the current line as second energizing time data, while assuming the energizing time data for the first preceding line, the second preceding line, and both adjacent dots of said target dot as first energizing time data, and further for performing a corrective operation for the energizing time data for said target dot using said selected reference data.

3. The thermal printer according to claim 2, wherein reference data is selected in said heat history correction table by assuming the energizing time data for a target dot in the current line as second energizing time data, while assuming the following energizing time data (1) to (3) as first energizing time data:

(1) energizing time data for both adjacent dots positioned on either side of said target dot;

(2) energizing time data for first-line adjacent dots constituting the first preceding line which are adapted to lie side-by-side, respectively, with said target dot and said both adjacent dots along said second direction; and (3) energizing time data for second-line adjacent dots constituting the second preceding line which are adapted to lie side-by-side, respectively, with said first-line adjacent dots along said second direction, and further a corrective operation is performed in such a manner as to change the start of energization in the energizing time data for said target dot using the following reference data (a) to (c):

(a) reference data based on the energizing time data for said target dot and for said both adjacent dots;

(b) reference data based on the energizing time data for said target dot and for said first-line adjacent dots; and (c) reference data based on the energizing time data for said target dot and for the dot lying side-by-side with said target dot along said second direction among said second-line adjacent dots, while in such a manner as to change the end of energization in the energizing time data for said target dot using the following reference data (d):

(d) reference data based on the energizing time data for said target dot and for the dots lying side-by-side, respectively, with said both adjacent dots along said second direction among said second-line adjacent dots.

4. The thermal printer according to claim 2, wherein reference data is selected in said heat history correction table by assuming the energizing time data for a target dot in the current line as second energizing time data, while assuming the following energizing time data (1) to (4) as first energizing time data:

(1) energizing time data for one of both adjacent dots of said target dot after a corrective operation;

(2) energizing time data for the other of said both adjacent dots of said target dot before a corrective operation;

(3) energizing time data for first-line adjacent dots constituting the first preceding line which are adapted to lie side-by-side, respectively, with said target dot and said both adjacent dots along said second direction; and (4) energizing time data for second-line adjacent dots constituting the second preceding line which are adapted to lie side-by-side, respectively, with said first-line adjacent dots along said second direction, and further a corrective operation is performed in such a manner as to change the start of energization in the energizing time data for said target dot using the following reference data (a) to (d):

(a) reference data based on the energizing time data for said target dot and for said one of said both adjacent dots of said target dot after a corrective operation;

(b) reference data based on the energizing time data for said target dot and for the other of said both adjacent dots of said target dot before a corrective operation;

(c) reference data based on the energizing time data for said target dot and for said first-line adjacent dots; and (d) reference data based on the energizing time data for said target dot and for the dot lying side-by-side with said target dot along said second direction among said second-line adjacent dots, while in such a manner as to change the end of energization in the energizing time data for said target dot using the following reference data (e):

(e) reference data based on the energizing time data for said target dot and for the dots lying side-by-side, respectively, with said both adjacent dots along said second direction among said second-line adjacent dots.

5. A method for correcting the energizing time data for heating elements in a thermal printer including a line head that has heating elements arranged in a first direction and adapted to energize and heat said heating elements based on energizing time data related to printing data to thermally transfer ink of an ink film onto a sheet that is carried in a second direction perpendicular to said first direction, said method comprising:

a first storing step of storing a heat history correction table that stores reference data related to first energizing time data and second energizing time data;

a second storing step of storing at least the energizing time data for the current line to be printed, the energizing time data for the first preceding line printed immediately before the current line, and the energizing time data for the second preceding line printed immediately before the first preceding line; and an operating step of obtaining energizing time data stored in said second storing step and of selecting reference data in said heat history correction table by assuming the energizing time data for a target dot in the current line as second energizing time data, while assuming the following energizing time data (1) to (3) as first energizing time data:

(1) energizing time data for both adjacent dots positioned on either side of said target dot;

(2) energizing time data for first-line adjacent dots constituting the first preceding line which are adapted to lie side-by-side, respectively, with said target dot and said both adjacent dots along said second direction; and (3) energizing time data for second-line adjacent dots constituting the second preceding line which are adapted to lie side-by-side, respectively, with said first-line adjacent dots along said second direction, and further of performing a corrective operation for the energizing time data for said target dot in such a manner as to change the start of energization in the energizing time data for said target dot using the following reference data (a) to (c):

(a) reference data based on the energizing time data for said target dot and for said both adjacent dots;

(b) reference data based on the energizing time data for said target dot and for said first-line adjacent dots; and (c) reference data based on the energizing time data for said target dot and for the dot lying side-by-side with said target dot along said second direction among said second-line adjacent dots, while in such a manner as to change the end of energization in the energizing time data for said target dot using the following reference data (d):

(d) reference data based on the energizing time data for said target dot and for the dots lying side-by-side, respectively, with said both adjacent dots along said second direction among said second-line adjacent dots.

6. A method for correcting the energizing time data for heating elements in a thermal printer including a line head that has heating elements arranged in a first direction and adapted to energize and heat said heating elements based on energizing time data related to printing data to thermally transfer ink of an ink film onto a sheet that is carried in a second direction perpendicular to said first direction, said method comprising:

a first storing step of storing a heat history correction table that stores reference data related to first energizing time data and second energizing time data;

a second storing step of storing at least the energizing time data for the current line to be printed, the energizing time data for the first preceding line printed immediately before the current line, and the energizing time data for the second preceding line printed immediately before the first preceding line; and an operating step of obtaining energizing time data stored in said second storing step and of selecting reference data in said heat history correction table by assuming the energizing time data for a target dot in the current line as second energizing time data, while assuming the energizing time data for the first preceding line, the second preceding line, and both adjacent dots of said target dot as first energizing time data, and further of performing a corrective operation for the energizing time data for said target dot using said selected reference data.

7. The method for correcting the energizing time data for heating elements in a thermal printer according to claim 6, wherein in said operating step, reference data is selected in said heat history correction table by assuming the energizing time data for a target dot in the current line as second energizing time data, while assuming the following energizing time data (1) to (3) as first energizing time data:

(1) energizing time data for both adjacent dots positioned on either side of said target dot;

(2) energizing time data for first-line adjacent dots constituting the first preceding line which are adapted to lie side-by-side, respectively, with said target dot and said both adjacent dots along said second direction; and (3) energizing time data for second-line adjacent dots constituting the second preceding line which are adapted to lie side-by-side, respectively, with said first-line adjacent dots along said second direction, and further a corrective operation is performed in such a manner as to change the start of energization in the energizing time data for said target dot using the following reference data (a) to (c):

(a) reference data based on the energizing time data for said target dot and for said both adjacent dots;

(b) reference data based on the energizing time data for said target dot and for said first-line adjacent dots; and (c) reference data based on the energizing time data for said target dot and for the dot lying side-by-side with said target dot along said second direction among said second-line adjacent dots, while in such a manner as to change the end of energization in the energizing time data for said target dot using the following reference data (d):

(d) reference data based on the energizing time data for said target dot and for the dots lying side-by-side, respectively, with said both adjacent dots along said second direction among said second-line adjacent dots.

8. The method for correcting the energizing time data for heating elements in a thermal printer according to claim 6, wherein in said operating step, reference data is selected in said heat history correction table by assuming the energizing time data for a target dot in the current line as second energizing time data, while assuming the following energizing time data (1) to (4) as first energizing time data:

(1) energizing time data for one of both adjacent dots of said target dot after a corrective operation;

(2) energizing time data for the other of said both adjacent dots of said target dot before a corrective operation;

(3) energizing time data for first-line adjacent dots constituting the first preceding line which are adapted to lie side-by-side, respectively, with said target dot and said both adjacent dots along said second direction; and (4) energizing time data for second-line adjacent dots constituting the second preceding line which are adapted to lie side-by-side, respectively, with said first-line adjacent dots along said second direction, and further a corrective operation is performed in such a manner as to change the start of energization in the energizing time data for said target dot using the following reference data (a) to (d):

(a) reference data based on the energizing time data for said target dot and for said one of said both adjacent dots of said target dot after a corrective operation;

(b) reference data based on the energizing time data for said target dot and for the other of said both adjacent dots of said target dot before a corrective operation;

(c) reference data based on the energizing time data for said target dot and for said first-line adjacent dots; and (d) reference data based on the energizing time data for said target dot and for the dot lying side-by-side with said target dot along said second direction among said second-line adjacent dots, while in such a manner as to change the end of energization in the energizing time data for said target dot using the following reference data (e):

(e) reference data based on the energizing time data for said target dot and for the dots lying side-by-side, respectively, with said both adjacent dots along said second direction among said second-line adjacent dots.

* * * * *